US006347438B1

(12) United States Patent
Fildan et al.

(10) Patent No.: US 6,347,438 B1
(45) Date of Patent: Feb. 19, 2002

(54) BRASSIERE FASTENER

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 09/662,299

(22) Filed: Sep. 15, 2000

Related U.S. Application Data

(63) Continuation-in-part of application No. 09/562,179, filed on May 2, 2000.

(51) Int. Cl.[7] ..... A44B 17/00; A41C 3/00

(52) U.S. Cl. ..... 24/662; 24/693; 24/667; 450/82; 450/86

(58) Field of Search ..... 24/114.4, 114.6, 24/662, 693, 669, 667, 673, 695, 701, 702; 450/82, 86, 88; 224/638, 637, 262, 628, 522, 523

(56) References Cited

U.S. PATENT DOCUMENTS

| | | | | | |
|---|---|---|---|---|---|
| 1,202,372 | A | * | 10/1916 | Foner | 24/675 |
| 2,122,138 | A | * | 6/1938 | Hansen | 24/667 |
| 3,019,152 | A | * | 1/1962 | Jones | 24/693 X |
| 4,805,273 | A | * | 2/1989 | Burke et al. | 24/663 |
| 4,825,516 | A | * | 5/1989 | Ackermann et al. | 24/693 |
| 6,253,428 | B1 | * | 7/2001 | Wan | 24/701 |

* cited by examiner

*Primary Examiner*—Robert J. Sandy
(74) *Attorney, Agent, or Firm*—Herbert Dubno

(57) ABSTRACT

A brassiere back closure can have flat circular injection molded male and female fastener halves connectable in a hook-and-eye fashion on respective tapes partly covered by brushed knitted strips and designed to be pulled apart for opening of the closure.

17 Claims, 15 Drawing Sheets

FIG. 10
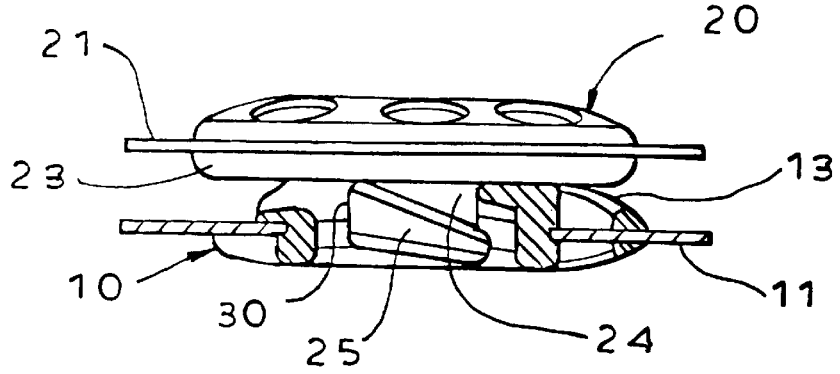
FIG. 11
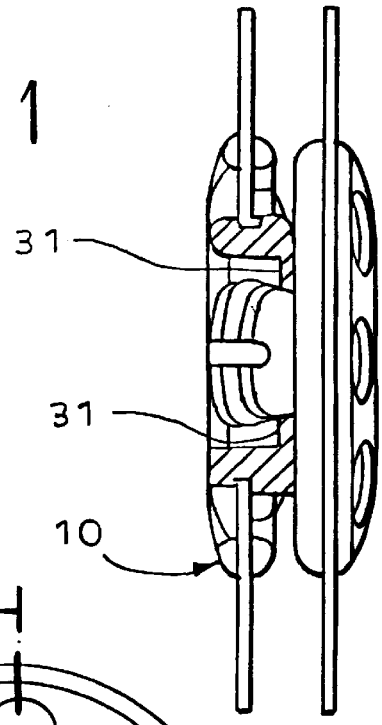
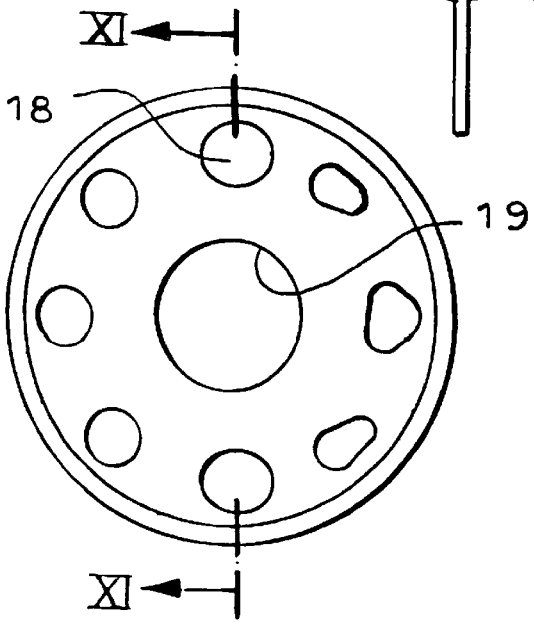
FIG. 9

FIG. 28
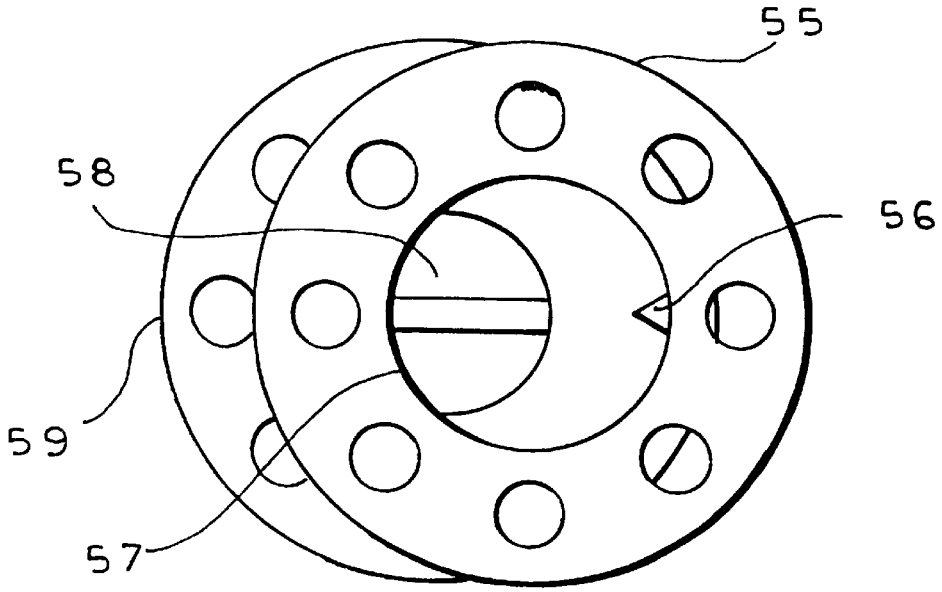
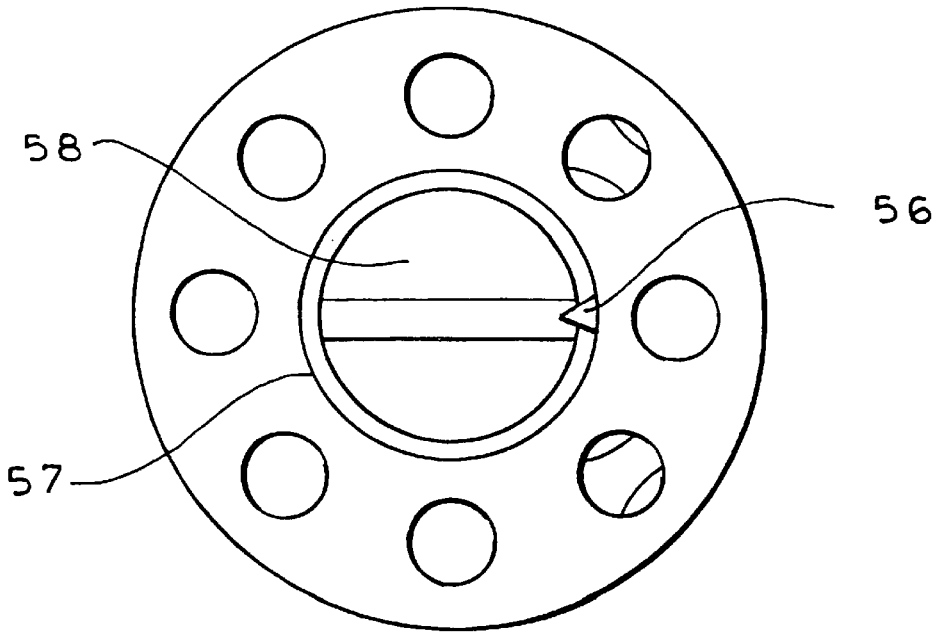
FIG. 29

BRASSIERE FASTENER

CROSS REFERENCE TO RELATED APPLICATION

This application is a continuation-in-part of copending application Ser. No. 09/562,179 filed May 2, 2000.

FIELD OF THE INVENTION

Our present invention relates to brassiere fasteners, particularly for the back strap of a brassiere and, in general, to so-called hook-and-eye fasteners generally used to interconnect two garment parts, especially, the parts of the back strap of a brassiere, or to snap-type and push button closures which can be used between garment parts. The invention is also applicable to fasteners for the cups of brassieres (as in maternity brassieres), to crotch fasteners in body suits and wherever secure closing and rapid and convenient opening is desirable in garments.

The invention, in particular, relates to strap fasteners of the type described in copending application Ser. No. 09/443,082 filed Nov. 18, 1999.

BACKGROUND OF THE INVENTION

In the past, the back strap of a brassiere has been connected via hook-and-eye fasteners in which, on one strap part, at least one and usually a multiplicity of hooks are provided for engagement into eyes correspondingly provided on another part of the strap. For wide straps the hooks and eyes can be provided two or three abreast and, to allow adjustability, one of the fastener members, either the hooks or eyes, may be spaced apart along the length of one of the strap portions. Where two or three fastener elements are provided across the width of the strap portion, rows of the elements may be spaced apart in the length of that fastener element.

While hook-and-eye fasteners of this type are convenient for fastening behind the back of the wearer, the nature of the hook caused the hook to press into the back of the wearer when, for example, the wearer might lean back against a supporting surface.

While press-button or snap-type fasteners are also known to couple fabric parts together, a press button being provided on one part with, for example, a mushroom-shaped compressible pin or projection and a receiving member on the other garment but formed with a hole which may be undercut to allow the head of the projection to engage beneath a rim or other formation, such fasteners are difficult to secure behind one's back because of the problem of aligning the pin with the hole and thus have not been successful as brassiere fasteners or the like.

Furthermore, the kind of adjustability and ease of connection afforded by hook-and-eye fasteners is not characteristic of earlier press button or snap-type fasteners.

The aforementioned copending application, which is incorporated herein in its entirety by reference, inter alia provides a fastener system which has characteristics of a press button or snap-type fastener and utilizes disk-shaped male and female halves which are connected by pin-and-eye formations and which, when joined, provide a particularly thin closure which can be separated by pulling apart the male and female fastener halves transversely to the tapes upon which they are provided.

Although this kind of closure represents a major advantage, particularly for back straps of brassieres, it is capable of further improvement.

OBJECTS OF THE INVENTION

It is, therefore, the principal object of the present invention to provide an improved garment closure which further develops the principles set forth in our copending application Ser. No. 09/443,082 and at the same time accomplishes the objects there set forth in a particularly convenient and effective manner.

It is another object of this invention to provide and improved garment fastener which is highly compact and comfortable for the garment wearer and is characterized by ease of manufacture, ease of connection and separation and particular suitability for delicate garments which might otherwise be damaged by washing or cleaning processes.

Still another object of the invention is to provide an improved brassiere fastener without many of the drawbacks of earlier hook-and-eye fasteners.

It is also an object of the invention to provide an improved method of making a garment fastener and especially a fastener for the back strap of the brassiere.

Another object is to provide an improved hook-and-eye and push button fastener which advances the principles of application Ser. No. 09/562,179.

SUMMARY OF THE INVENTION

These objects and others which will become apparent hereinafter are attained, in accordance with the invention, in a garment fastener which comprises:

a male fastener half injection-moldable onto a first tape and adapted to be secured to one part of a garment, the male fastener half being formed with a generally flat circular body having an outer body portion on one side of the first tape and an inner body portion on another side of the first tape, a pin projecting generally centrally from the inner body portion, and a head formed on the pin; and a female fastener half injection-moldable onto a second tape and adapted to be secured to another part of the garment, the female fastener half being formed with a generally flat circular body having an outer body portion on one side of the second tape and an inner body portion on another side of the second tape, the inner body portion having an eyelet dimensioned to receive and retain the head and an inlet slot leading to the eyelet through which the pin is laterally insertable, the head being withdrawable from the eyelet in a direction perpendicular to the tapes.

According to the invention, the slot has an inwardly convergent mouth and the head, which can be split for flexibility, is tapered from a narrow portion to a thick portion in a direction of insertion of the pin into the eyelet through the slot. The inner portion of the female fastener half can have inclined flanks engaging the head and guiding the head into the eyelet.

As in our earlier fastener it is highly advantageous to provide the inner body portion of one of the fastener halves as a convex element and the inner body portion of the other fastener half as a concave element which receives the convex inner body portion of the first fastener half in a nested relationship.

According to another aspect of the invention, each of the tapes may have a plurality of the respective fastener halves spaced apart thereon in a row transverse to the aforementioned insertion direction and for adjustability of the back strap, at least the tape provided with the female fastener members may have a plurality of such rows longitudinally spaced thereon.

The tapes may each be covered at least on one side with a brushed fabric strip ultrasonically welded to the tape along the edges and the garment part can be stitched or otherwise fastened between the respective tape and the brushed fabric strips.

The tapes can be woven of a synthetic resin yarn and the fastener halves can be composed of polyoxymethylene (POM) or polyamide (PA).

A brassiere according to the invention can have a back strap, portions of which are interconnected by at least one garment fastener comprising:

a male fastener half injection-moldable onto a first tape and adapted to be secured to one portions of the back strap, the male fastener half being formed with a generally flat circular body having an outer body portion on one side of the first tape and an inner body portion on another side of the first tape, a pin projecting generally centrally from the inner body portion, and a head formed on the pin;

a female fastener half injection-moldable onto a second tape and adapted to be secured to another of the portions of the back strap, the female fastener half being formed with a generally flat circular body having an outer body portion on one side of the second tape and an inner body portion on another side of the second tape, the inner body portion having an eyelet dimensioned to receive and retain the head and an inlet slot leading to the eyelet through which the pin is laterally insertable, the head being withdrawable from the eyelet in a direction perpendicular to the tapes; and a respective brushed fabric strip covering at least one side of each tape and ultrasonically welded to the respective tape along longitudinal weld seams, the respective part or portion of the back strap being inserted between each tape and the respective strip and being affixed thereto.

The method of the invention for making a garment fastener or a brassiere in which such a garment fastener is used can comprise:

(a) injection molding a multiplicity of male fastener halves onto a first woven synthetic-resin fabric band, the male fastener halves each being formed with a generally flat circular body having an outer body portion on one side of the first band and an inner body portion on another side of the first band, a pin projecting generally centrally from the inner body portion, and a head formed on the pin;

(b) injection molding a multiplicity of female fastener halves onto a second woven synthetic-resin fabric band, each of the female fastener halves being formed with a generally flat circular body having an outer body portion on one side of the second band and an inner body portion on another side of the second band, the inner body portion having an eyelet dimensioned to receive and retain the head and an inlet slot leading to the eyelet through which the pin is laterally insertable;

(c) covering at least one side of each of the bands with a strip of brushed knit fabric and ultrasonically welding the respective strip to the respective band along opposite longitudinal edges thereof to form respective weld seams having gaps therein;

(d) transversely severing the first band at gaps in the weld seams thereof to form first tapes each having at least one of the male fastener halves thereon and transversely severing the second band at gaps in the weld seams thereof to form second tapes each having at least one of the female fastener halves thereon, openings being provided between each tape and the respective strip at an end of the respective tape; and (e) inserting a respective garment portion into each of the openings and securing the respective garment portion to the respective tape and strip.

One of the advantages of the method of the invention is that the free ends of the tape/strip assembly to which the respective portions of the back strap are connected can be separated from the respective hands by cold cutting so that they remain relatively soft. Having not been stiffened by a heated cutting tool there is less likelihood of injury to the wearer from the fastener parts. The halves, when they are joined together by hooking motion, form a relatively thin flat closure without the danger of pressing into the back of the wearer. The thinness of the closure makes it less likely that the back strap of the brassiere will show through the outer garment of the wearer. The parts of the fastener can be connected by the standard hook-and-eye motion to which brassiere wearers are accustomed, although opening of the brassiere can be facilitated because the parts of the closure can be separated by simply pulling the strap parts apart.

We have found further that it is advantageous, when the head is split, to provide the female fastener half with a wedge-shaped projection opposite the inlet slot and engageable in the crevice to cam the parts of the split head apart upon insertion of the male fastener half into the female fastener half. This ensures a firm engagement of the two fastener halves and increases the ability of the garment fastener to withstand tensile, sheer and transverse stresses on the fastener.

It should also be mentioned that, while the male fastener half is inserted into the female fastener half by a sliding action analogous to the insertion of the hook into an eye for a conventional hook-and-eye fastener, it is also possible to press the head of the male fastener half into the female fastener half and to attach the two parts like a press button fastener. Of course, in either case, the male fastener half can be pulled out of the female fastener half to open the fastener by pulling apart the tapes in essentially the same direction in which the male fastener half has been hooked into one of the female fastener halves.

It has been found to be advantageous, further, to provide the tapes with some degree of resilience and that can be achieved by providing a cushion layer between the woven layer forming the carrier for the male or female fastener half and the outer layer which is usually a knitted strip, is ultrasonically welded to the woven strip and, on its surface turned toward the body of the wearer, has a brushed texture. In this case, the tapes where they press against the body are relatively soft. After the ultrasonic welding to provide the longitudinal seams along the edges of the tape, the tape can be transversely cold cut without forming a sharp edge during the mounting of the tape on the garment.

The fact that the strip which carries the male or female fastener half is a woven tape, ensures greater support for the male or female fastener half and thus the strength with which the tape resists tearing.

Finally we should mention that it has been found to be advantageous in some cases to provide at least one of the male and female halves as a tape which is a soft plastic film and which can, if desired, be a transparent film.

While the male and female fastener halves have been described as having circular bodies and a circular configuration may be preferred, it has been found to be advantageous in many cases to simply make the bodies annular and of either oval or circular configuration.

BRIEF DESCRIPTION OF THE DRAWING

The above and other objects, features, and advantages will become more readily apparent from the following description, reference being made to the accompanying drawing in which:

FIG. 9 is an elevational view of the fastener;

FIG. 10 is a cross sectional view taken along the line X—X of FIG. 9;

FIG. 11 is a cross sectional view along the line XI—XI of FIG. 9;

FIG. 28 is a diagrammatic illustration of the coupling of male and female fastener halves utilizing the wedge shaped projection;

FIG. 29 is a similar view showing the positions of the parts upon full coupling;

SPECIFIC DESCRIPTION

Figure 1:
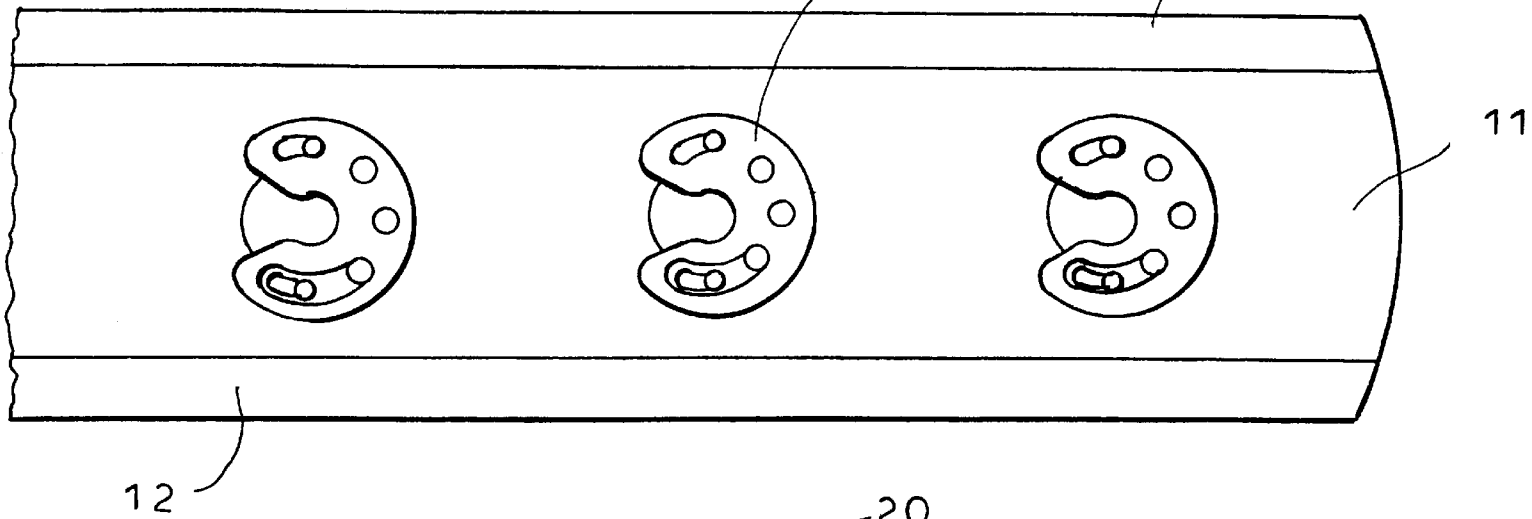
FIG. 1 is a plan view of a first tape covered with a brushed knit fabric strip which can be connected to one part of the back strap of a brassiere showing a plurality of female fastener halves according to the invention.
Figure 5:
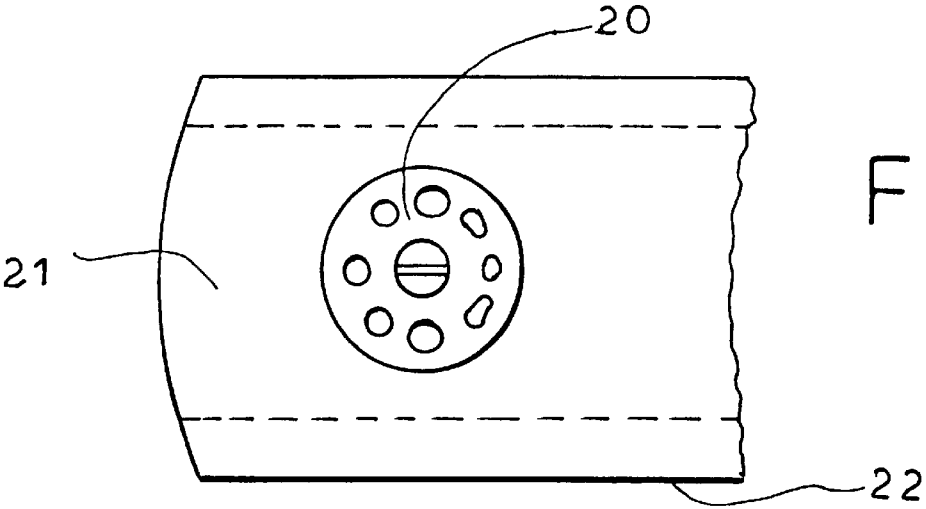
FIG. 5 is a view similar to FIG. 1 showing the tape portion with the male fastener half.
Figure 2:
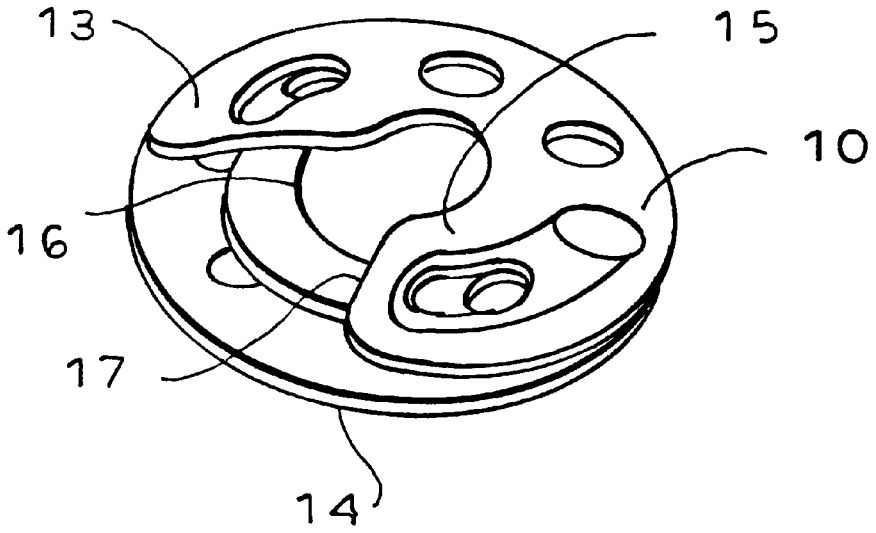
FIG. 2 is a perspective view of one of the female halves from its inner side.
Figure 3:
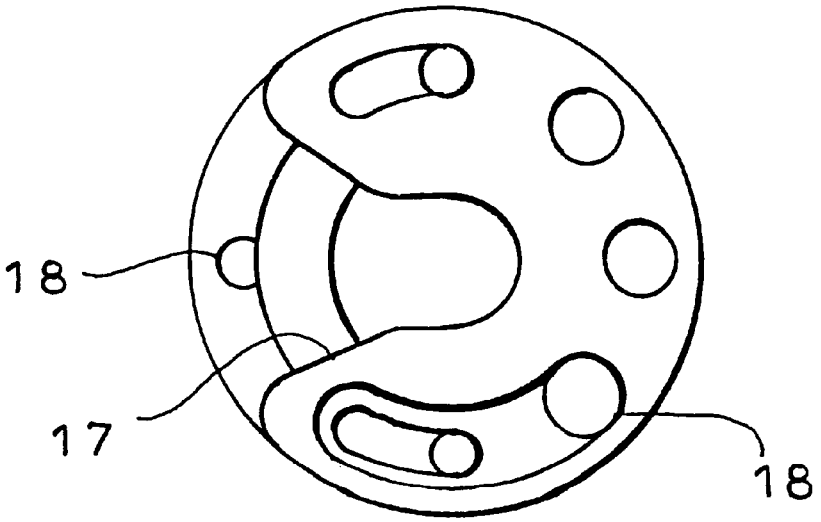
FIG. 3 is a plan view of the female fastener half.
Figure 4:
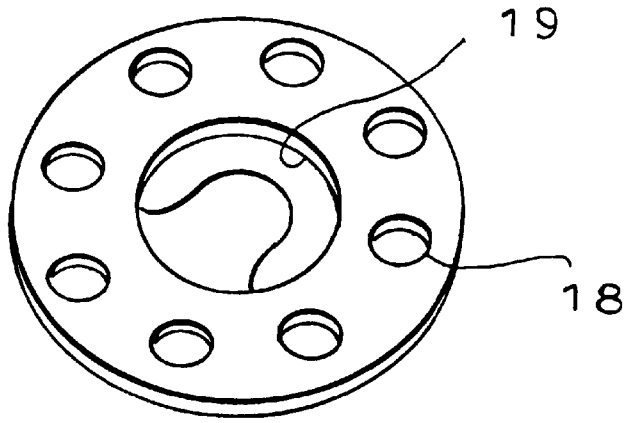
FIG. 4 is a perspective view of the female fastener half from its outer side.

As can be seen from FIG. 1, a plurality of female fastener halves 10 can be injection molded on a woven tape 11 of thermoplastic synthetic resin threads which is covered on one side by a knitted fabric strip as will be described in greater detail with reference to FIGS. 21–24, this strip being folded over onto the inner side of the tape at 12 and welded with a pair of longitudinal weld seams thereto. Each of the female fastener halves 10 (see FIG. 2) has an inner part 13 and an outer part 14 visible on opposite sides of the tape (not seen in FIGS. 2–4), the outer part or body 13 being formed with an eyelet 15 into which a slot 16 opens from the periphery of the inner part, this slot having an inwardly converging mouth 17.

Both the inner and outer parts can have throughgoing holes 18 which facilitate fastening of the injection molded body to the tape.

From the outer side, the eyelet appears as a hole 19 at a center of the injection molded body which may be composed of polyoxymethylene or polyamide.

Figure 7:
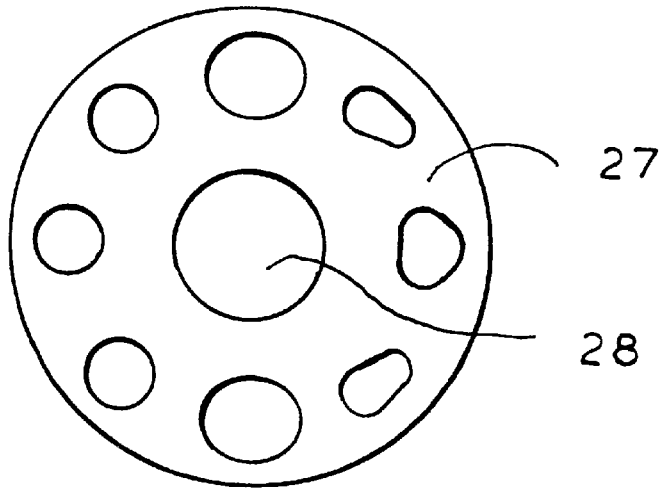
FIG. 7 is a plan view of the outer portion of the male fastener half.
Figure 6:
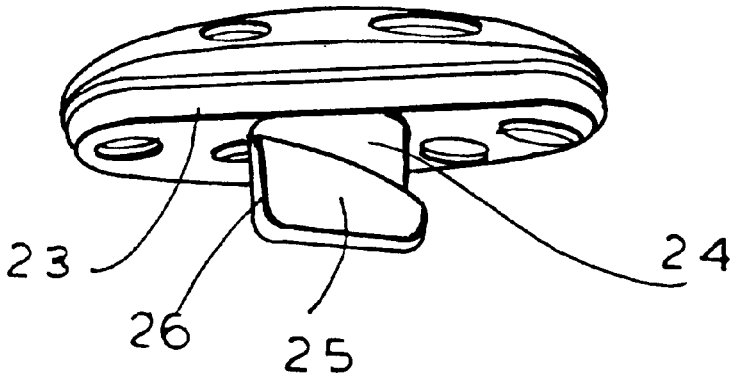
FIG. 6 is a perspective view of the male fastener half.
Figure 8:
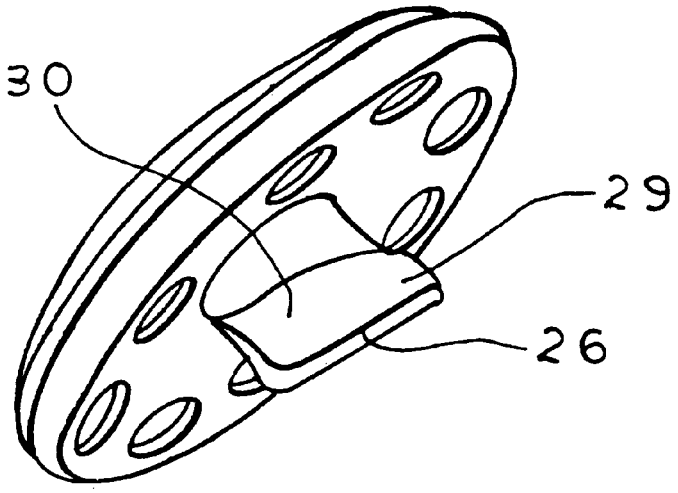
FIG. 8 is a perspective view of the male fastener half as seen from the side of its inner portion.
Figure 16:
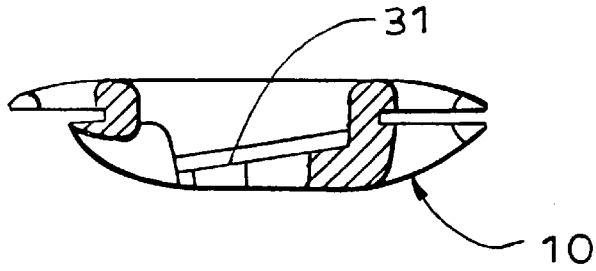
FIG. 16 is a cross sectional view thereof without the engagement of the head of the male half in the eyelet.
Figure 14:
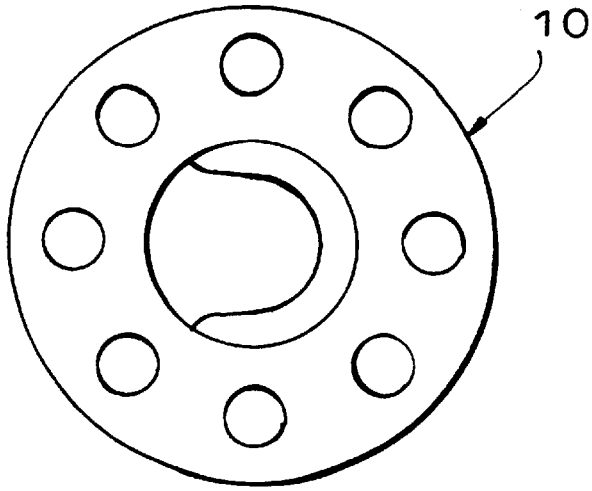
FIG. 14 is a top plan view thereof.
Figure 12:
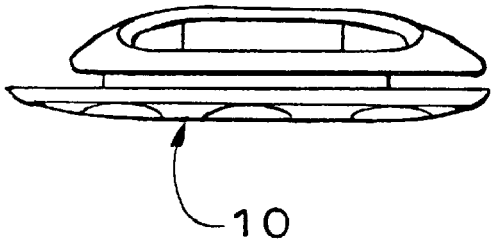
FIG. 12 is a side elevational view of the female fastener half.
Figure 19:
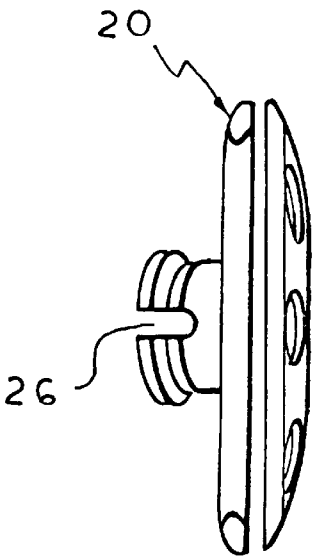
FIG. 19 is a front view of the male fastener half.
Figure 15:
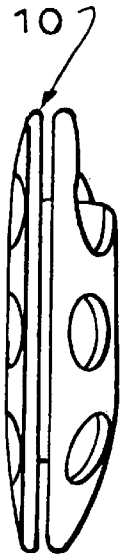
FIG. 15 is a rear view of the female member.

The male fastener half 20 (FIG, 5) may be injection molded on a woven tape 21 which likewise can be covered on its outer side by a strip of knitted fabric, folded over at 22 and ultrasonically welded to the tape. The male fastener half can have an inner body portion 23 formed with a post or pin 24 and a head 25 which is provided with a split 26. The outer body portion is shown at 27 in FIG. 7 and can have a hole 28 at its center aligned with the post. The head 25 tapers from a narrow end 29 to a thick end 30 (FIG. 8) in an insertion direction into the respective eyelet.

From FIG. 10 it will be apparent that the inner body portion 13 of the female fastener half 10, shown in FIG. 10 to be injection molded onto the tape 11, is convex and received in the concave inner body portion 23 of the male fastener half 20 injection molded onto its tape 21.

Figure 13:
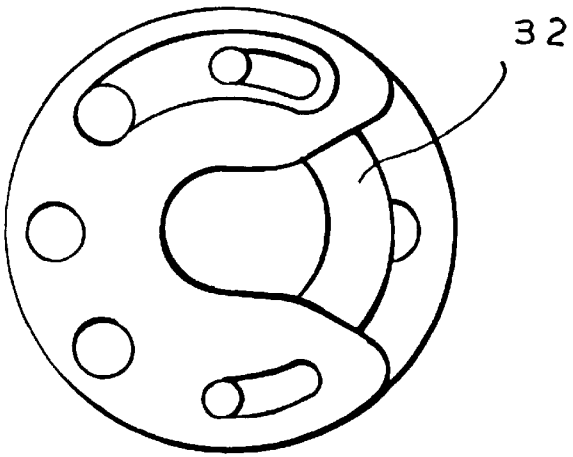
FIG. 13 is a bottom plan view thereof.
Figure 20:
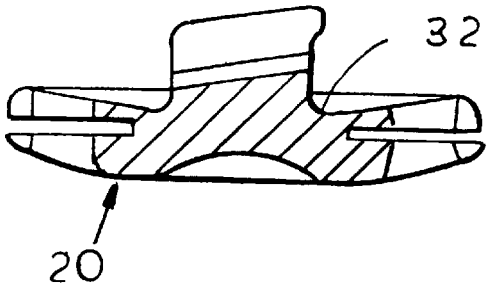
FIG. 20 is a cross section through the male fastener half.
Figure 18:
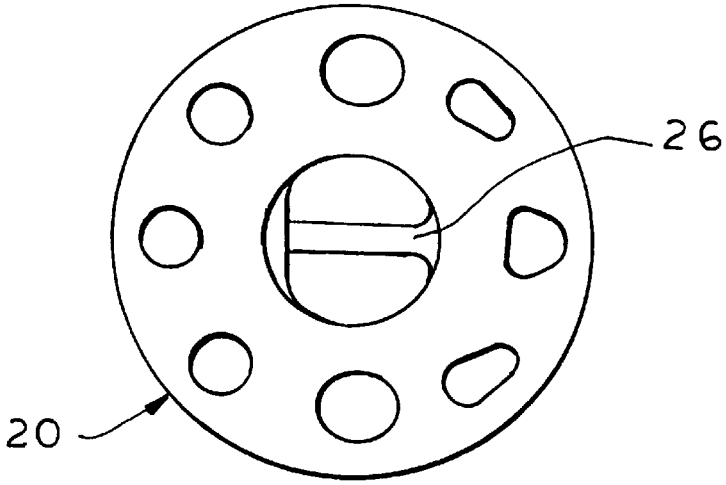
FIG. 18 is a bottom view of the male fastener half.
Figure 17:
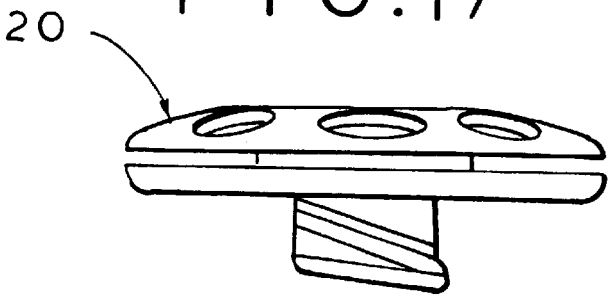
FIG. 17 is a side elevational view of the male fastener half.
Figure 21:
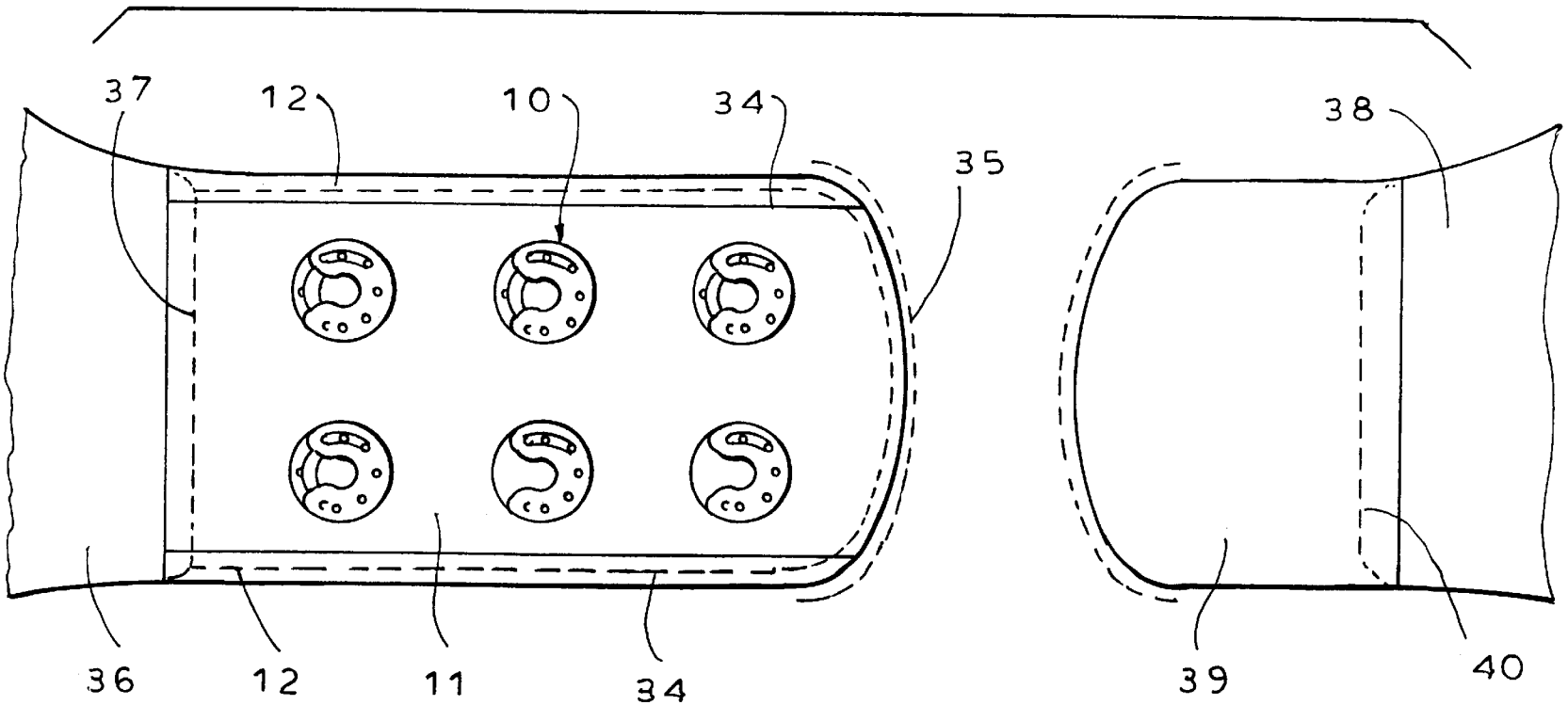
FIG. 21 is an elevational view of the back strap of a brassiere showing the application of the fastener thereto.
Figure 22:
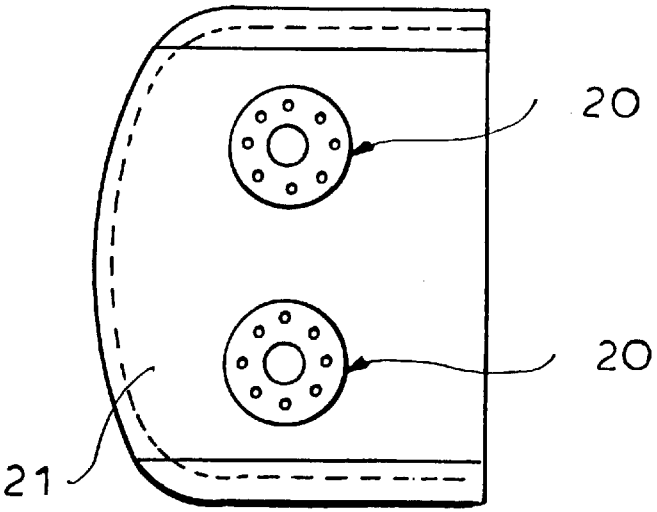
FIG. 22 is a view of one tape of the brassiere.

From FIGS. 10 and 11 it will also be apparent that the thicker portion 30 of the head 25 of the pin 24 lies to the rear of the eyelet and is guided into this position by inclined surfaces 31 of the female fastener half 10 (FIG. 11). The female fastener half is shown in greater detail in FIGS. 12–16 and has a rim 32 surrounding the eyelet and beneath which the thin portion 29 of the head drops when the head is inserted into the eyelet in the direction of A (FIG. 13). Because the head is split and can be squeezed together, the male fastener half can be pulled out of the female fastener half in a direction perpendicular to the tapes.

In FIGS. 17–20, the split 26 of the male fastener half 20 is shown in greater detail. From FIG. 20, moreover, the concavity 32 of the inner body portion of the male fastener head is shown in greater detail.

Figure 23:
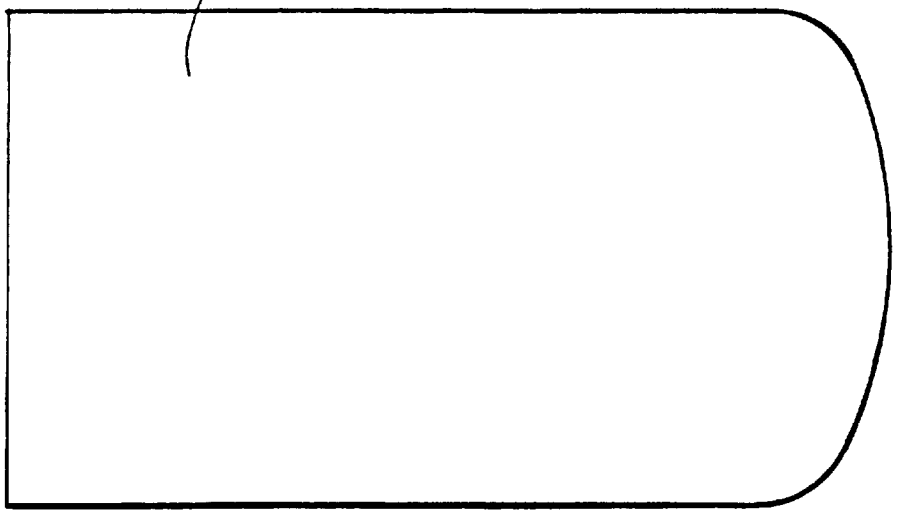
FIG. 23 is a view of the other tape.

As will be apparent form FIGS. 21–24, the female fastener halves 10 may be provided in a succession of rows on the tape 11 which is covered by the brushed tricot strip 33 shown in FIG. 23 so that the folded over edges 12 can be fastened to the tape 11 by ultrasonic weld seams 34 which can have a stitch pattern. The free end of the resulting band can be cold cut at 35 to leave a soft fluffy edge while the opposite end may be open for insertion of the part 36 of the back strap of the brassiere which can then be stitched in place along the seam 37. Similarly, the back strap portion 38 of the brassiere can be inserted between the tape 31 of the male fastener halves 20 and the brushed tricot strip 39 and stitched in place by a stitch seam 40.

Figure 24:
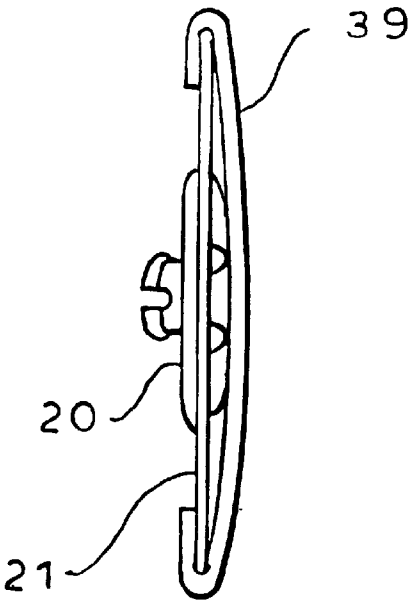
FIG. 24 is a cross section through the tape of the male fastener half.

In FIG. 24 the brushed tricot strip 39 and the woven synthetic resin tape 21 have been shown in greater detail and in section.

Figure 27:
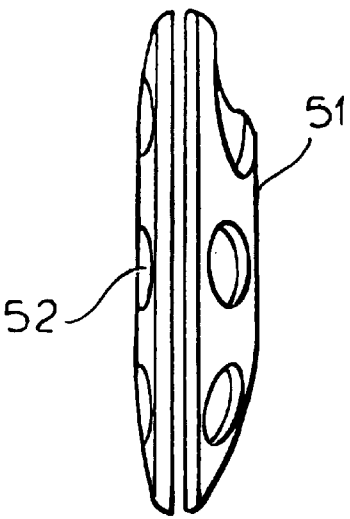
FIG. 27 is a side view of the latter fastener half.
Figure 25:
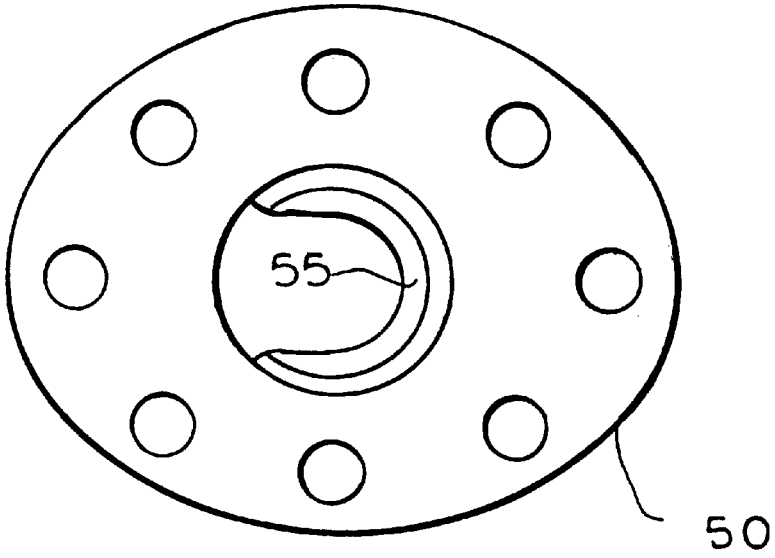
FIG. 25 is an elevational view of the back side of a female fastener half having a different configuration.
Figure 26:
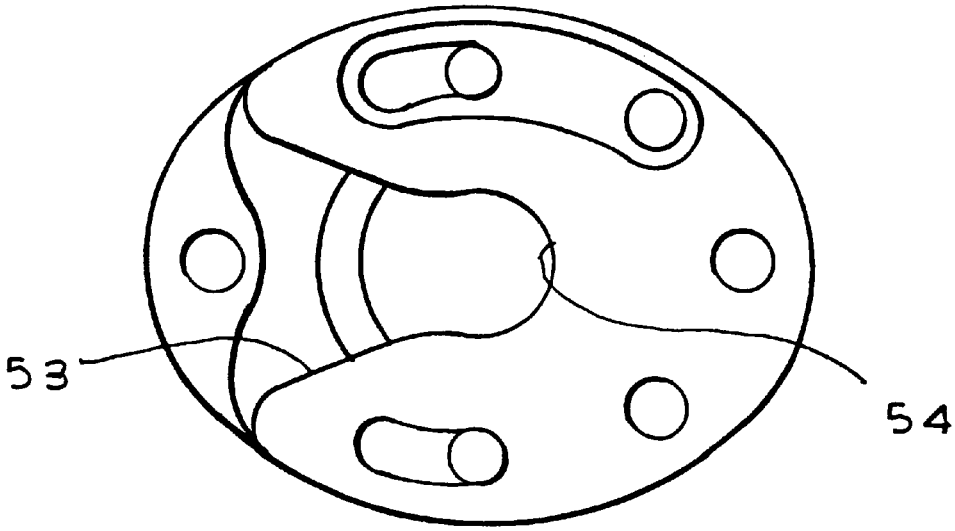
FIG. 26 is an elevational view of the front side of this latter fastener half.

From FIGS. 25–27, it will be apparent that the fastener halves and, for example, the female fastener half 50 can have annular configurations other than circular. For example, in FIGS. 25–27 the fastener half is shown to be oval and to be formed with body portions 51 and 52 injection molded on opposite sides of the woven fastener carrier (FIGS. 30–32) or on a thin soft flexible film 53 which may be transparent as shown in FIG. 33. The converging mouth 53 here leads to the central opening 54 which has a part 55 adapted to overhang the head of the male member in the manner previously described. In any of the embodiments, the female member 55, for example, can be provided with a wedge shaped projection 56 opposite the mouth 53 and positioned to engage in the crevice 57 formed in the head 58 when the male fastener half 59 is locked into the female fastener half as shown in FIG. 29, thereby causing the wedge 56 to cam the two parts of the head apart and increase the strength with which the male fastener half is returned in the female fastener half.

Figure 30:
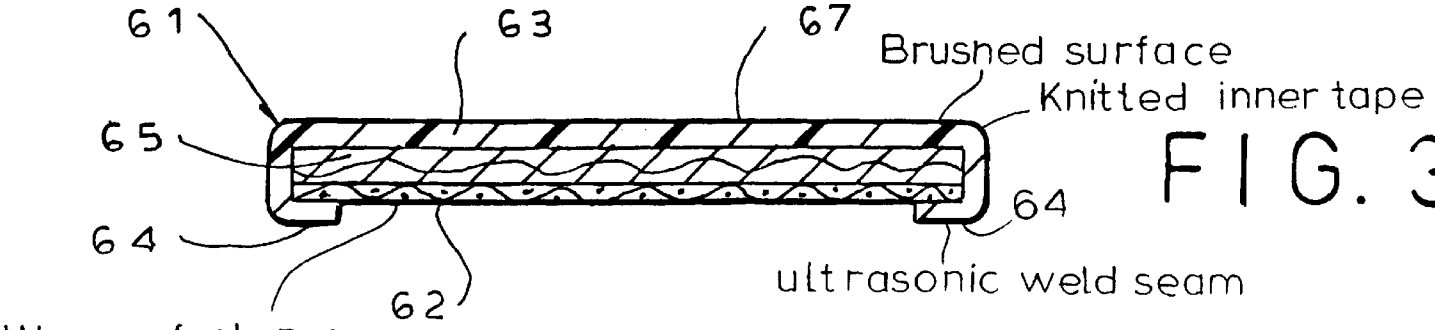
FIG. 30 is a cross sectional view drawn to an enlarged scale of the tape showing the cushioning strip.
Figure 31:
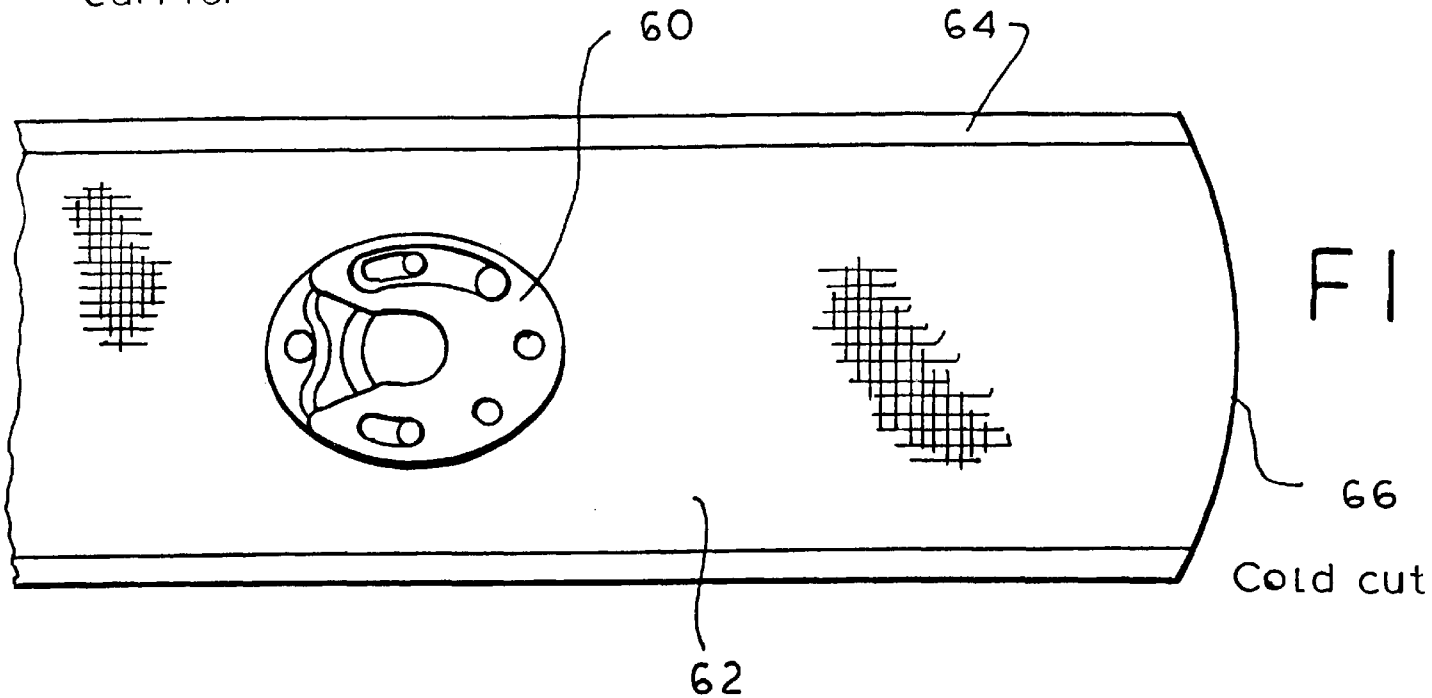
FIG. 31 is a plan view of the tape from the woven fastener carrier side.
Figure 32:
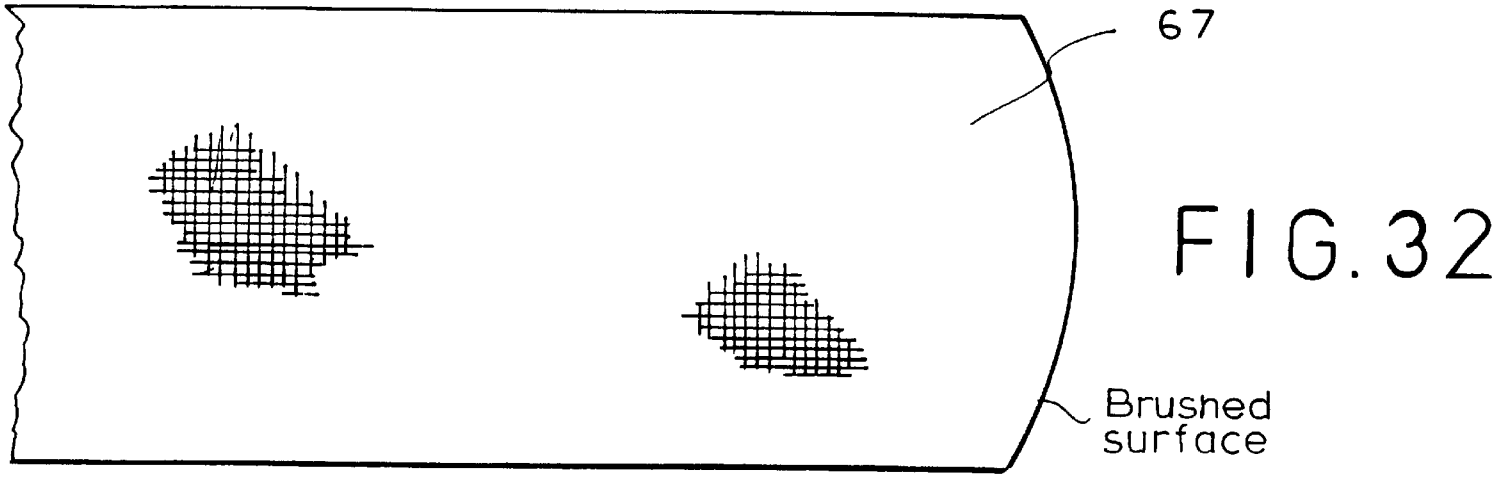
FIG. 32 is a plan view of this tape from the opposite side.
Figure 33:
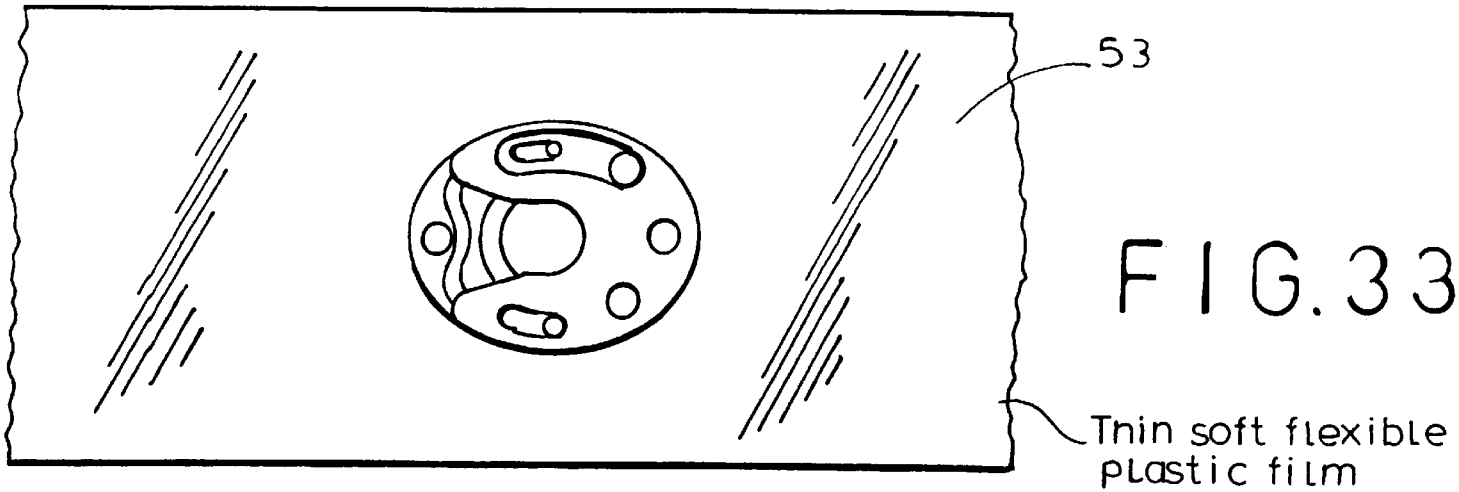
FIG. 33 shows the use of a thin soft flexible plastic film on which the fastener half is injection molded.

FIGS. 30–32 show the cushioning of the tape and, while illustrated with respect to a female fastener half 60 are applicable to both the male and the female fastener halves.

The tape 61 (FIG. 30) comprises the woven fastener carrier 62 on which the fastener halves 60, etc. are injection molded as previously described. The knitted outer strip 63 has overhanging edges 64 which are ultrasonically welded to the woven fastener carrier 62 and between these two strips is a cushioning strip which has been represented at 65 and can be a knitted tape, a nonwoven strip or even a foam material.

The edge of the tape can be cold cut transversely at 66 and the surface of the knitted cover strip turned toward the body of the wearer may be brushed at 67 to provide a particularly soft hand.

We claim:

1. A garment fastener comprising:

a male fastener half injection-molded onto a first tape and adapted to be secured to one part of a garment, said male fastener half being formed with a generally flat annular body having an outer body portion on one side of the first tape and an inner body portion on another side of the first tape, a pin projecting generally centrally from said inner body portion, and a head formed on said pin, said head being split and provided with two parts separated by a crevice; and a female fastener half injection-molded onto a second tape and adapted to be secured to another part of said garment, said female fastener half being formed with a generally flat annular body having an outer body portion on one side of the second tape and an inner body portion on another side of the second tape, said inner body portion having an eyelet dimensioned to receive and retain said head and an inlet slot leading to said eyelet through which said pin is laterally insertable, said head being withdrawable from said eyelet in a direction perpendicular to said tapes, said female fastener half being formed with a wedge-shaped projection opposite said inlet slot and engageable in said crevice to cam said parts apart upon insertion of said male fastener half into said female fastener half.

2. The garment fastener defined in claim 1 wherein said slot has an inwardly convergent mouth.

3. The garment fastener defined in claim 2 wherein said head is tapered from a narrow portion to a thick portion in a direction of insertion of said pin into said eyelet through said slot.

4. The garment fastener defined in claim 3 wherein said inner body portion of said female fastener half has inclined flanks engaging said head and guiding said head into said eyelet.

5. The garment fastener defined in claim 4 wherein said inner body portion of one of said fastener halves is convex and the inner body portion of the other of said fastener halves is concave to receive the convex inner body portion of said one of said fastener halves in a nested relationship.

6. The garment fastener defined in claim 1 wherein said tapes are woven and are each provided with a brushed-fabric strip along a side of the garment fastener turned toward the body of a wearer.

7. The garment fastener defined in claim 6 wherein each of said strips is ultrasonically welded to the respective tape along opposite longitudinal edges thereof.

8. The garment fastener defined in claim 7, further comprising a cushioning strip received between each tape and the respective brushed-fabric strip.

9. A garment fastener comprising:

a pair of fabric tapes each comprised of a woven strip forming a fastener carrier, a brushed fabric strip turned over onto and ultrasonically welded to the respective woven strip along opposite longitudinal edges thereof, and a cushioning strip received between each woven strip and the respective brushed fabric strip;

a male fastener half injection-molded onto a first of said woven strips and adapted to be secured by the respective tape to one part of a garment, said male fastener half being formed with a generally flat annular body having an outer body portion on one side of the first strip and an inner body portion on another side of the first strip, a pin projecting generally centrally from said inner body portion, and a head formed on said pin; and a female fastener half injection-molded onto a second of said woven strips and adapted to be secured by the respective tape to another part of said garment, said female fastener half being formed with a generally flat annular body having an outer body portion on one side of the second tape and an inner body portion on another side of the second tape, said inner body portion having an eyelet dimensioned to receive and retain said head and an inlet slot leading to said eyelet through which said pin is laterally insertable, said head being withdrawable from said eyelet in a direction perpendicular to said tapes.

10. The garment fastener defined in claim 9 wherein said body portions are circular.

11. The garment fastener defined in claim 9 wherein said body portions are generally oval.

12. The garment fastener defined in claim 9 wherein said head is split and provided with two parts separated by a crevice and said female fastener half is formed with a wedge-shaped projection opposite said inlet slot and engageable in said crevice to cam said parts apart upon insertion of said male fastener half into said female fastener half.

13. The garment fastener defined in claim 9 wherein said inner body portion of one of said fastener halves is convex and the inner body portion of the other of said fastener halves is concave to receive the convex inner body portion of said one of said fastener halves in a nested relationship.

14. The garment fastener defined in claim 13 wherein a respective portion of the garment is inserted between each tape and the respective strip and is affixed thereto.

15. The garment fastener defined in claim 14 wherein the respective portion of the garment is stitched to each tape and the respective strip.

16. A garment fastener comprising:

a male fastener half injection-molded onto a first tape and adapted to be secured to one part of a garment, said male fastener half being formed with a generally flat annular body having an outer body portion on one side of the first tape and an inner body portion on another side of the first tape, a pin projecting generally centrally from said inner body portion, and a head formed on said pin; and a female fastener half injection-molded onto a second tape and adapted to be secured to another part of said garment, said female fastener half being formed with a generally flat annular body having an outer body portion on one side of the second tape and an inner body portion on another side of the second tape, said inner body portion having an eyelet dimensioned to receive and retain said head and an inlet slot leading to said eyelet through which said pin is laterally insertable, said head being withdrawable from said eyelet in a direction perpendicular to said tapes, at least one of said tapes being composed of a soft plastic film.

17. The garment fastener defined in claim 16 wherein said soft plastic film is transparent.

* * * * *